US006893359B2

(12) United States Patent
Shimosaka

(10) Patent No.: US 6,893,359 B2
(45) Date of Patent: May 17, 2005

(54) METHOD FOR PREPARING A SOLID GOLF BALL

(75) Inventor: Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 49 days.

(21) Appl. No.: 10/326,110

(22) Filed: Dec. 23, 2002

(65) Prior Publication Data

US 2003/0153410 A1 Aug. 14, 2003

(30) Foreign Application Priority Data

Dec. 28, 2001 (JP) ..... 2001-399864

(51) Int. Cl.[7] ..... A63B 37/00
(52) U.S. Cl. ..... 473/351; 473/378; 425/116
(58) Field of Search ..... 473/378, 373, 473/374, 368, 367, 351; 425/116, 125, 129.1

(56) References Cited

U.S. PATENT DOCUMENTS 5,002,281 A 3/1991 Nakahara et al.
5,752,889 A 5/1998 Yamagishi et al.
6,248,028 B1 * 6/2001 Higuchi et al. ..... 473/374
6,267,694 B1 * 7/2001 Higuchi et al. ..... 473/374

FOREIGN PATENT DOCUMENTS

JP 02228978 A 9/1990
JP 07080848 A 3/1995

* cited by examiner

*Primary Examiner*—Raeann Gorden
(74) *Attorney, Agent, or Firm*—Sughrue Mion, PLLC

(57) ABSTRACT

A solid golf ball includes a core formed from a rubber composition and a cover directly covering the core. The cover is formed from a cover material mainly containing a thermoplastic urethane resin by injection molding using a mold composed of upper and lower mold halves. The core has a hardness, expressed by a deflection measured under an applied load of 5 kg to 130 kg, in a range of 2.0 mm or more. The cover has a thickness in a range of 0.9 mm to 1.7 mm. Assuming that a parting plane of the upper and lower mold halves is taken as an equator, each of the upper and lower mold halves has air vent portions in a region within a radius of 10 mm, measured as that projected on the equator plane, from a pole of the mold half. The total length of gaps of the air vent portions formed in the upper and lower mold halves is in a range of 90 mm or more. The width of each of the gaps of the air vent portions is in a range of 0.01 to 0.08 mm. The total area, measured as that projected on the equator plane, of the gaps of the air vent portions formed in the upper and lower mold halves is in a range of 1 to 5 $mm^2$. The solid golf ball exhibits a high resilience and excellent controllability and durability while keeping a soft feel when hit with a putter, and is particularly characterized in that even a thin cover can be stably formed around the core by injection molding,

10 Claims, 4 Drawing Sheets

METHOD FOR PREPARING A SOLID GOLF BALL

BACKGROUND OF THE INVENTION

The present invention relates to a solid golf ball produced by injection-molding a thermoplastic urethane resin relatively thinly around a core made from a rubber material.

Golf balls using covers made from thermoplastic urethane resins (hereinafter, often referred to simply "urethane covers") have been proposed. In the process of producing such a golf ball, it is recommended to form the urethane cover by injection molding from the viewpoint of easy molding. The injection molding for forming the urethane cover, however, has an inconvenience that the urethane cover material can be relatively easily injection-molded around a relatively smooth surface of a core made from an ionomer resin or a polyester elastomer, but is difficult to be thinly injection-molded around a rough surface of a core made from a rubber material. For example, it is easy to form an urethane cover having a relatively large thickness (for example. 1.9 mm or more) around a core made from a rubber material by injection molding, but it is difficult to form an urethane cover having a small thickness (for example, 0.8 mm or less) around a core made from a rubber material by injection molding.

To be more specific, at the time of injection-molding an urethane cover material around a core having a rough surface, it becomes often impossible for the cover material to sufficiently go round about the core. This is because the urethane cover material is affected by the rough surface of the cover and is thereby not uniformly injected around the core. In this case, since the cover material is not uniformly injected around the core, there may occur a phenomenon that air in a mold remains on the surface of the golf ball. In addition, if the core is largely deformed, it is also difficult to uniformly inject the cover material around the core.

SUMMARY OF THE INVENTION

In view of the foregoing, the present invention has been made, and an object of the present invention is to provide a solid golf ball produced by forming a thin urethane cover around a core made from a rubber material by injection molding, wherein the golf ball is capable of obtaining a sufficient initial speed while keeping a soft feel, and ensuring excellent controllability, hitting feel, and abrasion resistance.

To achieve the above object, the present inventor has studied, and found that a thin urethane cover can be directly, easily formed around a core made from a rubber material by injection molding by using a specific mold to be described later, and in this case, by optimizing the hardness of the core and the thickness of the cover, it is possible to improve the resilience of the golf ball while keeping a soft feel when hit with a putter, and to ensure excellent controllability and abrasion resistance of the golf ball. On the basis of such knowledge, the present invention having the following configurations has been accomplished.

According to an aspect of the present invention, there is provided a solid golf ball including: a core formed from a rubber composition; and a cover directly covering the core, the cover being formed from a cover material mainly containing a thermoplastic urethane resin by injection molding using a mold composed of upper and lower mold halves; wherein the core has a hardness, expressed by a deflection measured under an applied load of 5 kg to 130 kg, in a range of 2.0 mm or more; the cover has a thickness in a range of 0.9 mm to 1.7 mm; and assuming that a parting plane of the upper and lower mold halves is taken as an equator, each of the upper and lower mold halves has air vent portions in a region within a radius of 10 mm, measured as that projected on the equator plane, from a pole of the mold half, wherein the total length of gaps of the air vent portions formed in the upper and lower mold halves is in a range of 90 mm or more, the width of each of the gaps of the air vent portions is in a range of 0.01 to 0.08 mm, and the total area, measured as that projected on the equator plane, of the gaps of the air vent portions formed in the upper and lower mold halves is in a range of 1 to 5 $mm^2$.

Preferably, the air vent portions provided in each of the upper and lower mold halves include a first air vent portion formed around each of the poles of the upper and lower mold halves: and the first air vent portion is formed by inserting a dedicated air vent pin having a peripheral length of 5 mm or more in a first air vent pin hole with a first air vent gap having a width of 0.01 to 0.08 mm put therebetween.

Preferably, the air vent portions provided in each of the upper and lower mold halves include a plurality of second air vent portion provided around each of the poles of the upper and lower mold halves; the second air vent portion is formed by vertically movably inserting a core-supporting/air-vent movable pin in a second air vent pin hole with an air vent gap having a width of 0.01 to 0.08 mm put therebetween; and the total peripheral length of the movable pins in each of the upper and lower mold halves is in a range of 30 mm or more.

The second air vent portions may be formed in a region within a radius of 3 to 9 mm from each of the poles of the upper and lower mold halves.

The width of each of the gaps of the air vent portions may be in a range of 0.03 to 0.07 mm.

The total area of the gaps of the air vent portions in the upper and lower mold halves may be in a range of 1.8 to 3.4 $mm^2$.

The core may have a two-layer structure having an inner layer core and an outer layer core.

BRIEF DESCRIPTION OF THE DRAWINGS

Other features and advantages of the present invention will be apparent from the following description taken in conjunction with the accompanying drawings wherein.

DETAILED DESCRIPTION OF THE PREFERRED EMBODIMENTS

Figure 1:
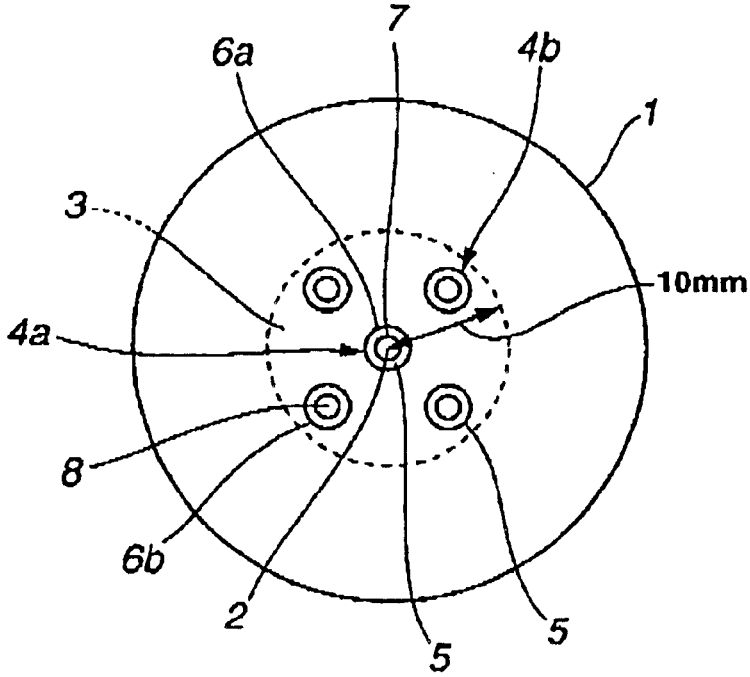
FIG. 1 is a schematic illustrative view showing one example of a mold for injection molding used for the present invention.

The present invention will be hereinafter described in more detail.

A solid golf ball of the present invention includes a core formed from a rubber composition and a cover formed so as to directly cover the core.

The rubber composition contains a main rubber component. The main rubber component may mainly contains polybutadiene, which preferably contains 40% or more, especially, 90% or more of cis-1,4-bonds. The main rubber component may contain, in addition to polybutadiene, a diene based rubber such as polyisoprene rubber, styrene-butadiene rubber, or natural rubber. The content of polybutadiene in the main rubber component is preferably in a range of 50% by weight or more, especially, 70% by weight or more.

The rubber composition used herein contains, in addition to the main rubber component, a crosslinking agent, preferably, in an amount of 15 to 50 parts ("parts by weight", the same applying correspondingly to the following) on the basis of 100 parts of the main rubber component. The crosslinking agent may be selected from zinc salts, magnesium salts, and other metal salts of unsaturated fatty acids such as zinc acrylate and zinc methacrylate, esters such as triethanolpropane methacrylate, and unsaturated fatty acids such as methacrylic acids.

The rubber composition may also contain an organic peroxide such as dicumyl peroxide, preferably, in an amount of 0.1 to 3 parts on the basis of 100 parts of the main rubber component. If necessary, the rubber composition may contain a vulcanizing agent such as an organic sulfur compound, for example, zinc salt of pentachlorothiophenol or diphenyldisulfide in an amount of 0.01 to 5 parts, especially, 0.2 to 3 parts on the basis of 100 parts of the main rubber component.

The rubber composition may further contain, if needed, an antioxidant such as 2,2-methylene bis(4-methyl-6-tert-buthylphenol), and a filler for adjustment of a specific gravity, such as zinc oxide, barium sulfate, or calcium carbonate. The filler may be generally contained in the main rubber component in an amount of 130 parts or less on the basis of 100 parts of the main rubber component. In particular, to improve the resilience of the core, the filler may be contained in the main rubber component in an amount of, preferably, 50 parts or less, more preferably, 45 parts or less, especially, 40 parts or less on the basis of 100 parts of the main rubber component. The lower limit of the content of the filler may be set to 1 part or more, especially, 3 parts or more, and further, 10 parts or more. In particular, to adjust a specific gravity, the filler composed of a combination of barium sulfate and zinc oxide is often used; however, from the viewpoint of improvement of the resilience of the core, it is preferred for the filler to mainly contain zinc oxide and additionally contain barium sulfate in a range of 10 parts or less, especially, 0 part.

The core can be prepared from the above-described rubber composition, for example, by kneading the components of the rubber composition in an ordinary kneader such as a Banbury mixer or a roll mill, and molding the resultant compound into a desired shape by a compression molding process or an injection molding process. In this molding process, vulcanization can be performed at a temperature of 130 to 180° C. for 10 to 60 min.

According to the golf ball of the present invention, the core may be a single layer core, a double-layer core having an inner layer core and an outer layer core, or a multi-layer core having three or more layer cores. In any case, the hardness of the entire core, which is expressed by a deflection under an applied load of 5 to 130 kg, may be in a range of 2.0 mm or more, preferably, 2.5 mm or more, more preferably, 2.8 mm or more, with the upper limit thereof being set to 4.0 mm or less, preferably, 3.0 mm or less. The core having such a hardness is effective to provide a golf ball having a high resilience while keeping a soft feel of hitting.

The diameter of the core may be in a range of 38.5 mm or more, especially, 39.0 mm or more, with the upper limit thereof being set to 40.5 mm or less. To small a diameter of the core makes the cover too thicker, which tends to reduce the resilience, thereby failing to a sufficient flight distance of the ball. Too large a diameter of the core makes the cover thinner, which tends to degrade the scratch resistance of the ball, and to make it difficult to form the cover by injection molding.

If the core is a double-layer core having an inner layer core and an outer layer core, the diameter of the inner layer core may be in a range of 29 to 36 mm, especially, 31 to 34 mm.

The diameter of the outer layer core may be, in a state covering the inner layer core, in a range of 38.5 mm or more, especially, 39.0 mm or more, with the upper limit thereof being set to 40.5 mm or less.

The hardness of the outer layer core is preferably higher than that of the inner layer core.

To increase the resilience of the core, it is preferable that the specific gravity of the outer layer core be smaller than that of the inner layer core by reducing the amount of the filler contained in the outer layer core.

According to the solid golf ball of the present invention, to effectively achieve the object of the present invention, the cover is made from a material mainly containing a polyurethane based elastomer. The polyurethane based elastomer may be any one of those known in the art.

The cover used herein, however, is preferably made from a cover molding material (C) containing a thermoplastic polyurethane material (A) and an isocyanate mixture (B). The isocyanate mixture (B) is obtained by dispersing an isocyanate compound (b-1) having two or more isocyanate groups as functional groups in one molecule in a thermoplastic resin (b-2) substantially unreactive with isocyanate.

With the use of the cover molding material (C) for forming the cover, it is possible to obtain a solid golf ball excellent in ball characteristics such as feel of hitting, controllability, cut resistance, abrasion resistance, and durability against cracking by repetitive hitting.

The components (A) and (B) contained in the cover molding material (C) will be described below.

Thermoplastic Polyurethane (A)

The thermoplastic polyurethane material includes a soft segment composed of high molecular polyol (polymeric glycol), a hard segment composed of a chain extender, and diisocyanate.

The high molecular polyol as a raw material is not particularly limited but may be any one of those known in the conventional technique in relation to a thermoplastic polyurethane material; however, to synthesize a thermoplastic polyurethane material having a high impact resilience and a low temperature characteristic, among a polyester based polyol and a polyether based polyol, the polyether based polyol is preferably used. Examples of the polyether based polyols include polytetramethylene glycol and polypropylene glycol. In particular, from the viewpoint of high impact resilience and low temperature characteristic, polytetramethylene glycol is more preferably used. The average molecular weight of the high molecular polyol may be generally set in a range of 1,000 to 5,000, and especially set in a range of 2,000 to 4,000 in order to synthesize a thermoplastic polyurethane material having a high impact resilience.

The chain extender may be one of those known in the conventional technique in relation to a thermoplastic polyurethane material. Examples of the chain extenders include 1,4-butylene glycol, 1,2-ethylene glycol, 1,3-butane diol, 1,6-hexane diol, and 2,2-dimethyl-1,3-propane diol. The average molecular weight of the chain extender may be in a range of 20 to 15,000.

The diisocyanate may be one of those known in the conventional technique in relation to a thermoplastic polyurethane material. Examples of the diisocyanates include aromatic diisocyanates such as 4,4'-diphenylmethane diisocyanate, 2,4-toluene diisocyanate, and 2,6-toluene diisocyanate; and aliphatic diisocyanates such as hexamethylene diisocyanate. It is to be noted that some kind of isocyanate has a difficulty in control of crosslinking reaction during injection molding of a thermoplastic polyurethane material. According to the present invention, from the viewpoint of stability of reaction with the isocyanate mixture (B) to be described later, 4,4'-diphenylmethane diisocyanate, which is the aromatic diisocyanate, is most preferably used.

The thermoplastic polyurethane material containing the above-described components is commercially available from DIC Bayer Polymer Ltd. under the trade names of Pandex T-8290, T-8295, and T-8260 and from Dainichiseika Color & Chemicals Mfg. Co., Ltd. under the trade names of Resamine 2593 and 2597.

Isocyanate Mixture (B)

The isocyanate mixture (B) is obtained by dispersing an isocyanate compound (b-1) having two or more isocyanate groups as functional groups in one molecule in a thermoplastic resin (b-2) substantially unreactive with isocyanate. The isocyanate compound (b-1) may be one of those known in the conventional technique in relation to a thermoplastic polyurethane material. Examples of the isocyanate compounds (b-1) include aromatic diisocyanates such as 4,4'-diphenylmethane diisocyanate, 2,4-toluene diisocyanate, and 2,6-toluene diisocyanate; and aliphatic diisocyanates such as hexamethylene diisocyanate. From the viewpoint of reactivity and working stability, 4,4'-diphenylmethane diisocyanate is preferably used.

The above-described thermoplastic resin (b-2) may be selected from those being low in water absorptivity and excellent in compatibility with a thermoplastic polyurethane material. Examples of such resins include a polystyrene resin, a polyvinyl chloride resin, an ABS resin, a polycarbonate resin, a polyester elastomer (for example, polyether-ester block copolymer or polyester-ester block copolymer). From the viewpoint of impact resilience and strength, a polyester elastomer, especially, polyether-ester block copolymer is preferably used.

The blending ratio of the thermoplastic resin (b-2) to the isocyanate compound (b-1) in the isocyanate mixture (B), which is expressed by the weight ratio of (b-2):(b-1), may be in a range of 100:5 to 100:100, preferably, 100;10 to 100:40. If the blending amount of the isocyanate compound (b-1) to the thermoplastic resin (b-2) is too small, a large amount of the isocyanate mixture (B) must be added to keep sufficient crosslinking reaction with the thermoplastic polyurethane material (A). As a result, the physical properties of the cover molding material (C) may become insufficient because of the increased effect of the thermoplastic resin exerted on the cover molding material (C). If the blending amount of the isocyanate compound (b-1) to the thermoplastic resin (b-2) is too large, the isocyanate compound (b-1) may be slipped during kneading of the isocyanate compound (b-1) and the thermoplastic resin (b-2), thereby making the synthesis of the isocyanate mixture (B) difficult.

The isocyanate mixture (B) can be obtained, for example, by blending the isocyanate compound (b-1) to the thermoplastic resin (b-2), sufficiently kneading them in a roll mill or a Banbury mixer at a temperature of 130 to 250° C., and pelletizing the kneaded material, or pulverizing the kneaded material after cooling it. The isocyanate mixture (B) is commercially available from Dainichiseika Color & Chemicals Mfg. Co., Ltd. under the trade name of Crossnate EM30.

Cover Molding Material (C)

The cover molding material (C) mainly contains the above-described thermoplastic polyurethane material (A) and isocyanate mixture (B). The blending ratio of the thermoplastic polyurethane material (A) to the isocyanate mixture (B), which is expressed by the weight ratio of A:B, may be in a range of 100:1 to 100:100, preferably, 100:5 to 100:50, more preferably, 100;10 to 100:30. If the blending amount of the isocyanate mixture (B) to the thermoplastic polyurethane material (A) is too small, the crosslinking effect may become insufficient. If the blending amount of the isocyanate mixture (B) to the thermoplastic polyurethane material (A) is too large, the unreacted isocyanate may cause a coloring phenomenon in a molded product.

The cover molding material (C) may contain, in addition to the thermoplastic polyurethane material (A) and the isocyanate mixture (B), other components, for example, a thermoplastic polymer material other than a thermoplastic polyurethane material. Examples of the thermoplastic polymer materials include a polyester elastomer, a polyamide elastomer, an ionomer resin, a styrene block elastomer, a polyethylene resin, and a nylon resin. The content of such a thermoplastic polymer material other than a thermoplastic polyurethane material may be in a range of 0 to 100 parts by weight, preferably, 10 to 75 parts by weight, more preferably, 10 to 50 parts by weight on the basis of 100 parts by weight of the thermoplastic polyurethane material (A) as the essential component of the cover molding material (C). The kind of the thermoplastic polymer material may be suitably selected from the viewpoint of improvement or adjustment of the hardness, resilience, flowability, and adhesiveness of the cover molding material (C). If needed, the cover molding material (C) may contain various additives such as a pigment, a dispersant, an antioxidant, a stabilizer against light, a UV absorber, and a mold releasing agent.

The cover of the solid golf ball of the present invention can be formed from the cover molding material (C), for example, by adding the isocyanate mixture (B) to the thermoplastic polyurethane material (A), mixing them in a dry state, and molding the resultant mixture around the previously prepared core by an injection molding machine. The molding temperature, which differs depending on the kind of the thermoplastic polyurethane material (A), is generally set in a range of 150 to 250° C.

During the formation of the cover of the golf ball by molding the cove molding material (C), the following reaction and crosslinking may occur in the cover molding material (C). Namely, isocyanate groups may react with remaining OH-groups of the thermoplastic polyurethane material, to form urethane bonds, or isocyanate groups may additionally react with urethane groups of the thermoplastic polyurethane material, to cause allophanate and biuret crosslinking forms. In this case, the crosslinking reaction does not sufficiently proceed immediately after injection molding of the cover molding material (C), and it proceeds by annealing performed after injection molding, to obtain characteristics useful as the cover of the solid golf ball. The wording "annealing" is a heating/aging treatment performed at a specific temperature in a specific period of time, or an aging treatment performed at room temperature in a specific period of time.

The cover according to the present invention is formed from a material mainly containing a polyurethane based elastomer as described above, and the Shore D hardness of the cover may be in a range of 45 or more, preferably, 48 or more, with the upper limit thereof being set to a value in a range of 60 or less, preferably, 52 or less. It is to be noted that the measurement of the hardness of the cover is performed by preparing a sheet made from the same cover molding material, and measuring the hardness of the sheet.

The thickness of the cover may be in a range of 0.9 mm or more, especially, 1.2 mm or more, with the upper limit thereof being set to a value in a range of 1.7 mm or less, especially, 1.5 mm or less. Too small a thickness of the cover may degrade the abrasion resistance and cause a variation in spin performance, whereas too large a thickness of the cover fails to obtain a sufficient resilience.

According to the present invention, as described above, the cover is formed by injection-molding the cover molding material (C). In this injection molding, there is used a mold composed of upper and lower mold halves shown in FIG. 1. As shown in FIG. 1, assuming that a parting plane of the upper and lower mold halves is taken as an equator 1, each of the upper and lower mold halves has air vent portions 4*a* and 4*b* in a region 3 within a radius of 10 mm, measured as that projected on the equator plane, from a pole 2 of the mold half.

In this case, the air vent portion may be a simple slit, or an air vent pin hole in which a pin is to be inserted. The width of an air vent gap 5 of each air vent portion is required to be in a range of 0.01 mm or more, especially, 0.02 mm or more, with the upper limit thereof being set to a value in a range of 0.08 mm or less, especially, 0.04 mm or less. It is to be noted that in the case of providing the simple slit, the air vent gap 5 is the gap of the slit itself, whereas in the case of providing the air vent pin hole, the air vent gap 5 is the gap between the pin hole and the pin inserted in the pin hole. The total length of the air vent gaps of the air vent portions formed in the upper and lower mold halves is required to be in a range of 90 mm or more, preferably, 120 mm or more, with the upper limit thereof being set to a value in a range of 200 mm or less, especially, 180 mm or less. The total area of the air vent gaps of the air vent portions formed in the upper and lower mold halves, which is measured as the total area projected on the equator plane, is required to be in a range of 1 $mm^2$ or more, especially, 1.8 $mm^2$ or more, with the upper limit thereof being set to a value in a range of 5 $mm^2$ or less, especially, 3.4 $mm^2$ or less.

If the total length of the above-described air vent gaps is too short, air venting may become poor, to cause a number of molding failures in the process of forming the golf ball having a thin layer urethane cover by injection molding. Meanwhile, if the total length of the air vent gaps Is too long, the proportion of the deformed shape of each dimple may become large at the time of formation of the dimples, which may often exert adverse effect on the flight characteristics and the external appearance of the golf ball.

If the width of the air vent gap is too narrow, air venting may become poor, thereby tending to cause a number of molding failures in the process of forming the golf ball having a thin layer urethane cover by injection molding. Meanwhile, if the width of the air vent gap is too wide, the edge shape of each dimple may be degraded, which exerts adverse effect on the flight characteristics and the external appearance of the golf ball. If the total area of the air vent gaps is too small, a large number of molding failures tend to occur in the process of forming the golf ball having the thin layer urethane cover by injection molding. Meanwhile, if the total area of the air vent gaps is too large, the proportion of the deformed shape of each dimple may become large at the time of formation of the dimples, which exerts adverse effect on the flight characteristics and the external appearance of the golf ball.

The above-described air vent portions formed in each of the upper and lower mold halves preferably include a first air vent portion 4*a* provided around each of the poles, preferably, at each of the poles of the upper and lower mold halves. The first air vent portion 4*a* is configured as an air vent pin hole in which a dedicated air vent pin 7 is fixed or movably inserted with a first air vent gap 6*a* put therebetween. The peripheral length of the air vent pin 7 may be in a range of 5 mm or more, especially, 12 mm or more, with the upper limit thereof being set to a value in a range of 24 mm or less, especially, 15 mm or less. The shape of the air vent pin hole is not particularly limited but is preferably a circular shape, or a shape not interfering with any dimple. The shape of the leading end of the pin may be selected depending on the shape of the air vent pin, for example, a dimple shape or a bank shape.

The above-described air vent portions formed in each of the upper and lower mold halves preferably include a plurality (preferably, 3 to 8, especially, 4 to 5 pieces) of second air vent portions 4*b* provided around each of the poles, preferably, in a region within a radius of 3 to 9 mm, measured as that projected on the equator plane, from the pole of the mold half. The second air vent portions 4*b* are preferably spaced from each other at nearly equal intervals in such a manner as to surround the first air vent portions 4*a*. In this case, the second air vent portion 4*b* may be configured as an air vent pin hole in which a core-supporting/air-vent movable pin 8 is vertically movably inserted with a second air vent gap 6*b* put therebetween.

The total peripheral length of the movable pins 8 provided in the upper and lower mold halves may be in a range of 30 mm or more, especially, 48 mm or more, with the upper limit thereof being set to a value In a range of 90 mm or less, especially, 72 mm or less. Like the first air vent portion, the shape of the air vent pin hole is not particularly limited but is preferably a circular shape, or a shape not interfering with any dimple, and the shape of the leading end of the pin may be selected depending on the shape of the air vent pin, for example, a dimple shape or a bank shape.

The conditions of injection molding may be set such that the cover molding material melted at a temperature of 200 to 250° C. be injection-molded at a one-step injection speed or two-step or more injection speed. As a result, an injection rate in a range of $2.0\times10^4$ to $2.5\times10^5$ $mm^3$/sec can be attained. In this injection molding, the holding pressure may be set in a range of 1 to 4.5 MPa. The core supporting pins are preferably pulled out nearly at the time when the cover material reaches the core supporting pins.

The golf ball of the present invention can be produced by any process known in the art, except that the cover is formed from the cover molding material by injection molding using the above-described mold, and after the formation of the cover, the golf ball may be polished, painted, and the like by any process known in the art.

The diameter and the weight of the golf ball of the present invention may be specified in accordance with the Rules of Golf, for example, with the diameter specified in a range of 42.67 mm or more and the weight specified in a range of 45.93 g or less.

The solid golf ball of the present invention can be applied to a two-piece golf ball, a three-piece golf ball, or the like, and is advantageous in obtaining a high resilience while keeping a soft feel when hit with a putter, ensuring good controllability and durability, and is particularly characterized in that even a thin cover can be stably formed around the core by injection molding.

EXAMPLE

The present invention will be described in more detail with reference to the following examples, although not limited thereto.

Examples 1 to 5 and Comparative Examples 1 to 3

Cores shown in Table 4 were produced by using rubber compositions shown in Table 1. It is to be noted that in Comparative Example 3, an intermediate layer made from an ionomer resin was formed around the core. Each of cover materials shown in Table 3 was formed around the corresponding one of the cores thus prepared by injection molding using a mold having a specification shown in Table 2. To be more specific, after the core was set in the mold, the cover material melted at 225° C. was injection-molded in a cavity of the mold at an injection rate determined by three-step injection speeds (first speed: $1.5\times10^5$ $mm^3$/sec, second speed: $1.0\times10^5$ $mm^3$/sec, and third speed; $5.0\times10^4$ $mm^3$/sec), to obtain a golf ball having a dimple arrangement (total number of dimples: 432) shown in FIG. 2. In this injection molding, the holding pressure was set to 2 MPa, and core supporting pins were pulled out when the cover material reached the supporting pins.

Figure 2:
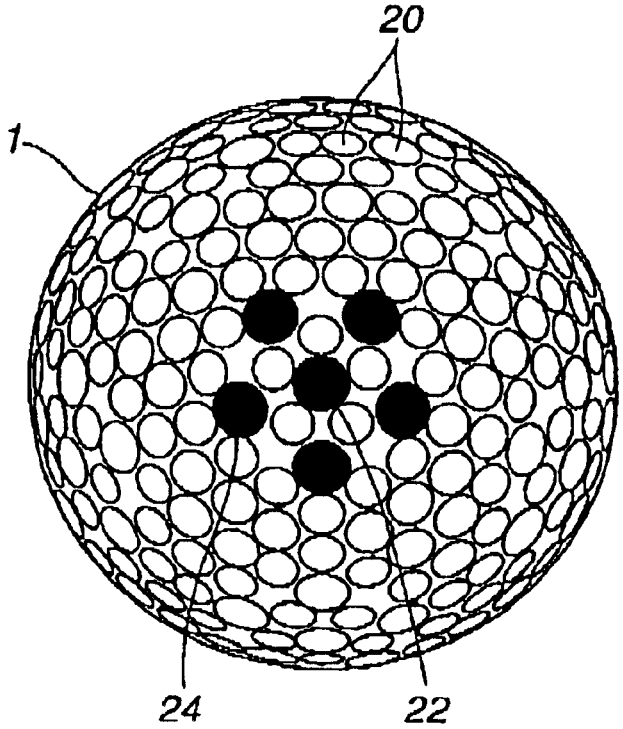
FIG. 2 is a plan view showing a dimple arrangement adopted in Examples 1 to 5 and Comparative Examples 1 to 3.

In FIG. 2, reference numeral 20 denotes a dimple, 22 is a mark of a dedicated air vent pin, and 24 is a mark of a ore-supporting/air-vent pin.

Each of the golf balls thus obtained was evaluated in terms of initial speed and spin, approach spin, a putter impact force, and abrasion resistance in accordance with the following methods. The results are shown in Table 4.

Initial Speed, Spin

The golf ball was hit at an HS (Head Speed)=45 m/s with a driver (W#1) (trade name: Tour Stage X500 (loft angle: 8°) produced by Bridgestone Sports Co., Ltd.), and the initial speed and spin rate thereof were measured.

Approach Spin

The spin rate of the golf ball at the time of hitting the ball at an HS=22 m/s with a sand wedge (trade name: J'r Classical Edition, produced by Bridgestone Sports Co. Ltd.) was measured.

Putter Impact Force

An acceleration sensor was attached to a putter, and a peak acceleration at the time of hitting the golf ball with the putter was measured. In this case, the peak acceleration for each of the golf balls in Examples and Comparative Examples was relatively evaluated with the peak acceleration for the golf ball in Comparative Example 3 taken as 100.

Abrasion Resistance

The golf ball was relatively cuttingly hit with a sand wedge at room temperature, and the mark was observed in accordance with the following criterion:

○: negligible

Δ: barely usable

X: not usable

TABLE 1

| | Example | | | | | Comparative Example | | |
|---|---|---|---|---|---|---|---|---|
| | 1 | 2 | 3 | 4 | 5 | 1 | 2 | 3 |
| Composition of material for inner core (Parts by weight) | | | | | | | | |
| Polybutadiene *1 | | 100 | | | | | | |
| Zinc acrylate | | 30.1 | | | | | | |
| Peroxide (1) *2 | | 0.6 | | | | | | |
| Peroxide (2) *3 | | 0.6 | | | | | | |
| Antioxidant *4 | | 0.2 | | | | | | |
| Zinc oxide | | 15.2 | | | | | | |
| Zinc salt of pentachlorothiophenol | | 1 | | | | | | |
| Zinc stearate | | 5 | | | | | | |
| Vulcanizing temperature/ vulcanizing time | | 157° C. 15 min | | | | | | |
| Composition of material for core (Parts by weight) | | | | | | | | |
| Polybutadiene *1 | 100 | 100 | 100 | 100 | 100 | 100 | 100 | 100 |
| Zinc acrylate | 35.3 | 38.0 | 35.3 | 34.6 | 35.6 | 35.3 | 35.4 | 32.5 |
| Peroxide (1) *2 | 0.6 | 0.6 | 0.6 | 0.6 | 0.6 | 0.6 | 0.6 | 0.6 |
| Peroxide (2) *3 | 0.6 | 0.6 | 0.6 | 0.6 | 0.6 | 0.6 | 0.6 | 0.6 |
| Antioxidant *4 | 0.2 | 0.2 | 0.2 | 0.2 | 0.2 | 0.2 | 0.2 | 0.2 |
| Zinc oxide | 11.9 | 8.5 | 11.9 | 12.2 | 11.6 | 11.9 | 18.7 | 22.0 |
| Zinc salt of pentachlorothiophenol | 1 | 1 | 1 | 1 | 1 | 1 | 1 | 1 |

TABLE 1-continued

| | Example | | | | | Comparative Example | | |
|---|---|---|---|---|---|---|---|---|
| | 1 | 2 | 3 | 4 | 5 | 1 | 2 | 3 |
| Zinc stearate | 5 | 0 | 5 | 5 | 5 | 5 | 5 | 5 |
| Vulcanizing temperature/ vulcanizing time | 157° C. 15 min | 157° C. 15 min | 157° C. 15 min | 157° C. 15 min | 157° C. 15 min | 157° C. 15 min | 157° C. 15 min | 157° C. 15 min |

*1 JSR BR11
*2 Peroxide (1): dicumyl peroxide (trade name; Percumyl D, produced by Nippon Oil & Fats Co., Ltd.)
*3 Peroxide (2); 1,1-bis(t-butylperoxy)-3,3,5-trimethylcyclohexene (trade name: Perhexa, produced by Nippon Oil & Fats Co., Ltd.)
*4 Nocrac NS-6 (Ouchi Shinko Chemical Industries Co.)

TABLE 2

| Specification of mold for injection molding | Circular shape |
|---|---|
| **Shape of dedicated air vent pin hole** | |
| Diameter (mm) of dedicated air vent pin hole | 4.16 |
| Peripheral length (mm) of dedicated air vent pin | 13.07 |
| Width (mm) of dedicated air vent pin | 0.03 |
| Number of dedicated air vent pin (One side) | 1 |
| Total area ($mm^2$) of dedicated air vent portion (One side) | 0.39 |
| **Shape of core-supporting/Air-vent pin hole** | |
| Diameter (mm) of core-supporting/Air-vent pin hole | 4.14 |
| Peripheral length (mm) of core-supporting/Air-Vent pin | 13.01 |
| Width (mm) of core-supporting/Air-vent pin | 0.02 |
| Number of core-supporting/Air-vent pins (One side) | 5 |
| Total peripheral length (mm) of core-supporting/Air-vent pins (One side) | 65 |
| Total area ($mm^2$) of core-supporting/Air-vent portions (One side) | 1.29 |
| Distance (mm) between center of core-supporting/ Air-vent portion and pole (Measured as that projected on equator) | 6.24 |
| Total peripheral length (mm) of entire air vent pins (Both sides) | 156 |
| Total area ($mm^2$) of entire air vent portions (Both sides) | 3.37 |

TABLE 3

| | | A | B | C | D | E |
|---|---|---|---|---|---|---|
| Compostion of cover material (Parts by weight) | Pandex T8295 | 100 | | 50 | | |
| | Pandex T8290 | | | 50 | | |
| | Pandex T8260 | | 100 | | | |

TABLE 3-continued

| | A | B | C | D | E |
|---|---|---|---|---|---|
| Himilan 1557 | | | | 20 | 40 |
| Himilan 1855 | | | | 30 | |
| Himilan 1601 | | | | | 60 |
| Surlyn 8120 | | | | 30 | |
| AN 4311 | | | | 20 | |
| Titanium dioxide | 2 | 2 | 2 | 2 | |
| Polyethylene wax | 1.5 | 1.5 | 1.5 | | |
| Isocyanate mixture | 10 | 10 | 10 | | |

The trade names "Pandex", Surlyn", "Himilan", and "AN4311", and the material name "isocyanate mixture" in Table 3 are as follows:

"Pandex" series: produced by DIC Bayer Polymer Ltd., thermoplastic polyurethane elastomer "Surlyn": produced by EI DuPont de Nemours & Company, ionomer resin "Himilan" series: produced by DuPont-Mitsui Polychemicals Co., Ltd., ionomer resin "AN4311": produced by DuPont-Mitsui Polychemicals Co., Ltd., ethylene-methacrylic acid-acrylic ester ternary copolymer "Isocyanate Mixture": produced by Dainichiseika Color & Chemicals Mfg. Co., Ltd. under trade name of Crossnate EM30 [Note: an isocyanate master batch containing 30 wt % of 4,4'-diphenylmethane diisocyanate (isocyanate concentration measured by amine back titration under JIS-K1556: 5–10 wt %) was used and a polyester elastomer was used as master batch base resin; and the isocyanate mixture was kneaded before injection]

TABLE 4

| | Example | | | | | Comparative Example | | |
|---|---|---|---|---|---|---|---|---|
| | 1 | 2 | 3 | 4 | 5 | 1 | 2 | 3 |
| Ball structure | 2P | 3P | 2P | 2P | 2P | 2P | 2P | 3P |
| **Inner core** | | | | | | | | |
| Hardness (mm) | | 3.50 | | | | | | |
| Diameter (mm) | | 32.2 | | | | | | |
| Weight (g) | | 19.84 | | | | | | |

TABLE 4-continued

| | | Example | | | | | Comparative Example | | |
|---|---|---|---|---|---|---|---|---|---|
| Ball structure | | 1 2P | 2 3P | 3 2P | 4 2P | 5 2P | 1 2P | 2 2P | 3 3P |
| Core | | | | | | | | | |
| Hardness (mm) | | 2.85 | 2.82 | 2.86 | 2.93 | 2.81 | 2.84 | 2.83 | 3.20 |
| Diameter (mm) | | 39.8 | 39.8 | 40.5 | 39.8 | 39.8 | 38.7 | 39.8 | 36.2 |
| Weight (g) | | 37.27 | 37.23 | 39.27 | 37.27 | 37.24 | 34.26 | 38.56 | 29.38 |
| Intermediate layer | | | | | | | | | |
| Material | | | | | | | | | E |
| Hardness (mm) | | | | | | | | | 2.82 |
| Diameter (mm) | | | | | | | | | 39.80 |
| Weight (g) | | | | | | | | | 37.19 |
| Cover | | | | | | | | | |
| Material | | A | A | A | B | C | A | D | A |
| Thickness (mm) | | 1.45 | 1.45 | 1.10 | 1.45 | 1.45 | 2.00 | 1.45 | 3.24 |
| Hardness (Shore D) | | 50 | 50 | 50 | 54 | 47 | 50 | 50 | 50 |
| Ball | | | | | | | | | |
| Hardness (mm) | | 2.67 | 2.64 | 2.69 | 2.66 | 2.67 | 2.66 | 2.64 | 2.65 |
| Diameter (mm) | | 42.7 | 42.7 | 42.7 | 42.7 | 42.7 | 42.7 | 42.7 | 42.7 |
| Weight (g) | | 45.58 | 45.54 | 45.58 | 45.58 | 45.55 | 45.58 | 45.55 | 45.50 |
| Physical property of ball | | | | | | | | | |
| HS = 45 | Initial speed (m/s) | 68.7 | 68.7 | 68.8 | 68.6 | 68.6 | 68.2 | 68.8 | 68.6 |
| | Spin (rpm) | 2800 | 2700 | 2800 | 2600 | 2900 | 2800 | 2700 | 2700 |
| Approach spin (rpm) | | 6400 | 6500 | 6300 | 5800 | 6700 | 6500 | 5800 | 6500 |
| Putter impact force | | 95 | 93 | 94 | 94 | 96 | 98 | 101 | 100 |
| Abrasion resistance | | ○ | ○ | ○ | ○ | ○ | ○ | X | Δ |

Examples 6 to 8 and Comparative Examples 4 and 5

Golf balls In Examples 6 to 8 and Comparative Examples 4 and 5 were obtained in the same manner as that used In Example 1, except for the use of molds for injection molding shown in Table 5 and dimple arrangements shown in FIGS. 3 to 7 for Examples 6 to 8 and Comparative Examples 4 and 5, respectively. The degree of air entrainment for each of the golf balls was evaluated by the following method. The results are shown in Table 5.

Degree of Air Entrainment

The degree of air entrainment of each of the golf balls was evaluated on the basis of visual observation of a streak having a length of 1 mm or more or a depression having an area of 1 $mm^2$ or more due to air on the surface of the cover.

TABLE 5

Figure 3:
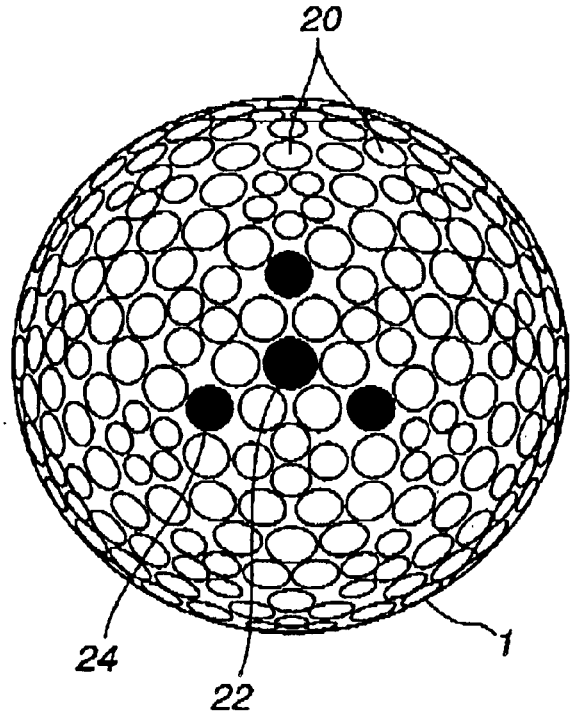
FIG. 3 is a plan view showing a dimple arrangement adopted in Example 6.
Figure 4:
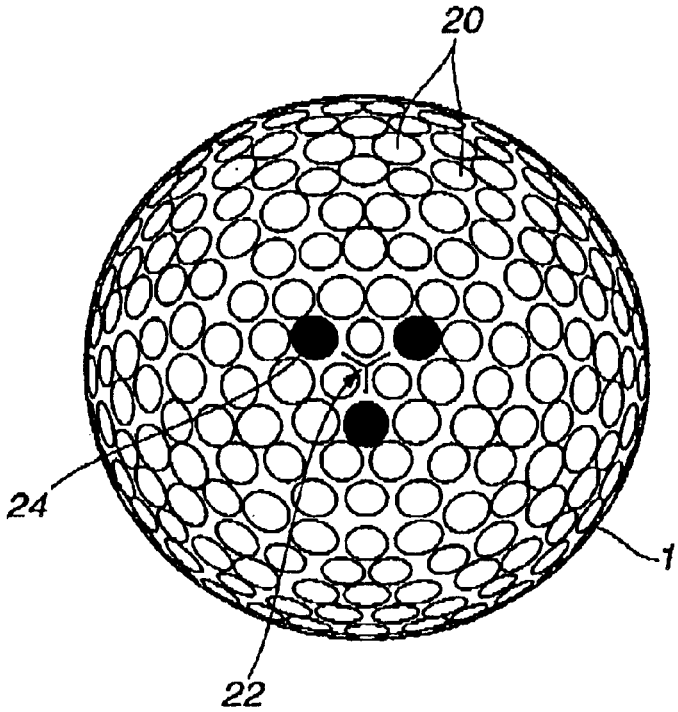
FIG. 4 is a plan view showing a dimple arrangement adopted in Example 7.
Figure 5:
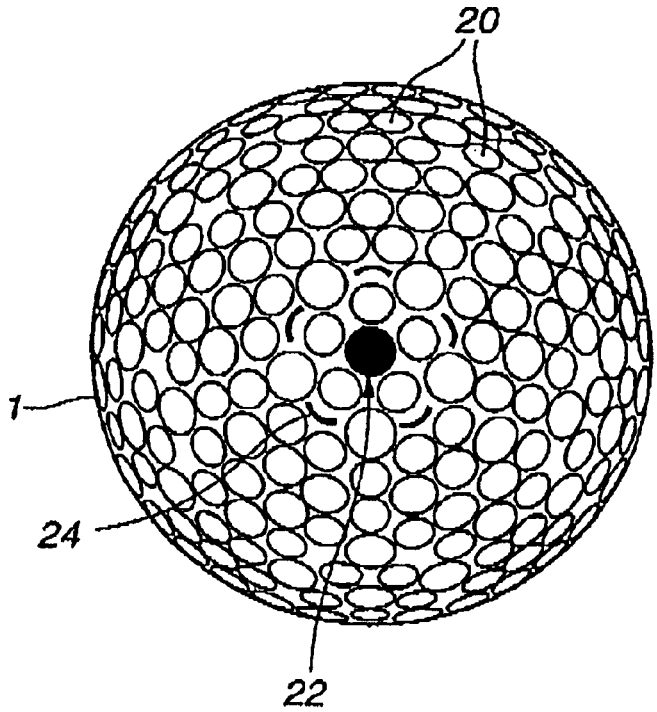
FIG. 5 is a plan view showing a dimple arrangement adopted in Example 8.
Figure 6:
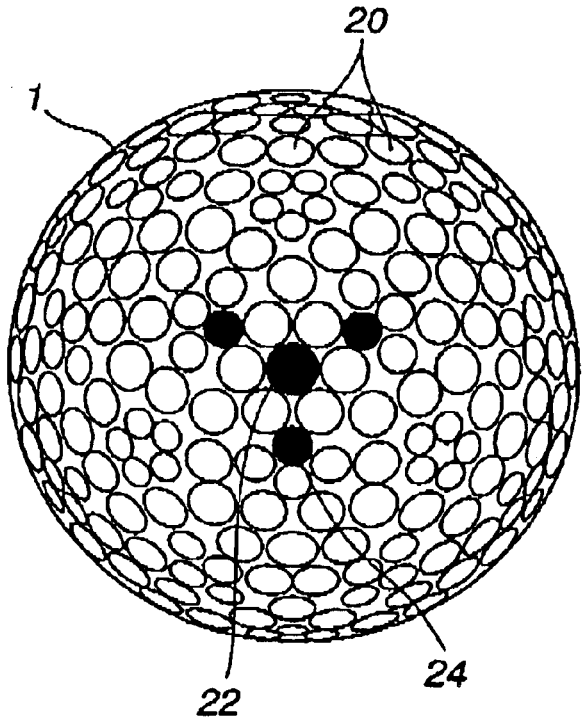
FIG. 6 is a plan view showing a dimple arrangement adopted in Comparative Example 4.
Figure 7:
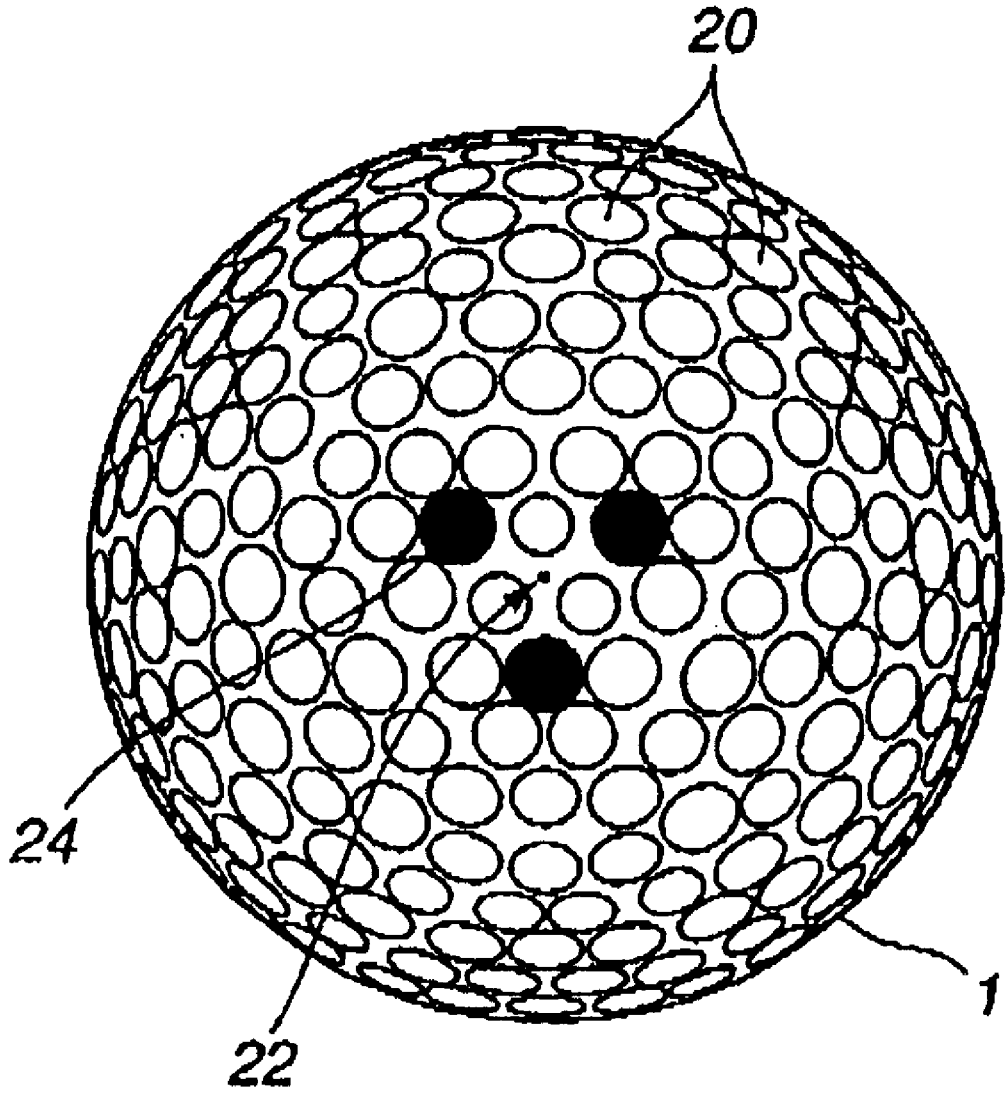
FIG. 7 is a plan view showing a dimple arrangement adopted in Comparative Example 5.

| | Example | | | | Comparative Example | |
|---|---|---|---|---|---|---|
| Dimple arrangement | 1 FIG. 2 | 6 FIG. 3 | 7 FIG. 4 | 8 FIG. 5 | 4 FIG. 6 | 5 FIG. 7 |
| Shape of dedicated air vent pin hole | Circular shape | Circular shape | Y-shape | Circular shape | Circular shape | Circular shape |
| Diameter (mm) of dedicated air vent pin hole | 4.16 | 4.04 | | 4.16 | 4.04 | 1.24 |
| Peripheral length (mm) of dedicated air vent pin | 13.07 | 12.69 | 9.00 | 13.07 | 12.69 | 3.90 |
| Width (mm) of dedicated air vent pin | 0.03 | 0.02 | 0.02 | 0.03 | 0.02 | 0.02 |
| Number of dedicated air vent pin (one side) | 1 | 1 | 1 | 1 | 1 | 1 |
| Total area ($mm^2$) of dedicated air vent portion (one side) | 0.39 | 0.25 | 0.18 | 0.39 | 0.25 | 0.08 |
| Shape of core-supporting/ Air-vent pin hole | Circular shape | Circular shape | Circular shape | Sector shape | Circular shape | Circular shape |
| Diameter (mm) of core-supporting/Air-vent pin hole | 4.14 | 3.74 | 3.94 | | 3.04 | 3.94 |
| Peripheral length (mm) of core-supporting/Air-vent pin | 13.01 | 11.75 | 12.38 | 8.23 | 9.55 | 12.38 |

TABLE 5-continued

| | Example | | | | Comparative Example | |
|---|---|---|---|---|---|---|
| Dimple arrangement | 1 FIG. 2 | 6 FIG. 3 | 7 FIG. 4 | 8 FIG. 5 | 4 FIG. 6 | 5 FIG. 7 |
| Width (mm) of core-supporting/Air-vent pin | 0.02 | 0.02 | 0.02 | 0.02 | 0.02 | 0.02 |
| Number of core-supporting/Air-vent pins (one side) | 5 | 3 | 3 | 5 | 3 | 3 |
| Total peripheral length (mm) of core-supporting/Air-vent pins (one side) | 65 | 35 | 37 | 41 | 29 | 37 |
| Total area ($mm^2$) of core-supporting/Air-vent portions (one side) | 1.29 | 0.70 | 0.74 | 0.16 | 0.57 | 0.74 |
| Distance (mm) between center of core-supporting/Air-vent portion and pole (Measured as that projected on equator) | 6.24 | 7.08 | 4.64 | 6.25 | 6.14 | 4.64 |
| Total peripheral length (mm) of entire air vent pins (both sides) | 156 | 96 | 92 | 108 | 83 | 82 |
| Total area ($mm^2$) of entire air vent portions (Both sides) | 3.37 | 1.91 | 1.84 | 1.11 | 1.64 | 1.63 |
| Air entrainment in 500 shots | 0 | 2 | 12 | 3 | 83 | 282 |
| Degree of air entrainment | none | small | small | small | small | large |

As is apparent from the results shown in Tables 4 and 5, the golf ball of the present invention is capable of obtaining a high resilience while keeping a soft feel when hit with a putter and ensuring excellent controllability and abrasion resistance, and is also capable of eliminating or reducing the degree of air entrainment although a relatively thin cover is formed around a core by injection molding.

While the preferred embodiments of the present invention have been described using specific terms, such description is for illustrative purposes only, and it is to be understood that changes and variations may be made without departing from the spirit and scope of the following claims.

What is claimed is:

1. A method for preparing a solid golf ball, comprising the steps of:

placing a solid core formed from a rubber composition in a mold composed of upper and lower mold halves;

injection molding a cover material mainly containing a thermoplastic urethane resin around the surface of said solid core so as to directly cover the solid core, wherein in said mold, assuming that a parting plane of said upper and lower mold halves is taken as an equator, each of said upper and lower mold halves has air vent portions in a region within a radius of 10 mm, measured as that projected on the equator plane, from a pole of said mold half, and the total length of gaps of said air vent portions formed in said upper and lower mold halves is in a range of 90 mm or more, the width of each of the gaps of said air vent portions is in a range of 0.01 to 0.08 mm, and the total area, measured as that projected on the equator plane, of the gaps of said air vent portions in said upper and lower mold halves is in a range of 1 to 5 $mm^2$, thereby to prepare the solid golf ball wherein said solid core has a hardness, expressed by a deflection measured under an applied load of 5 kg to 130 kg, in a range of 2.0 mm or more, and said urethane cover has a thickness in a range of 0.9 mm to 1.7 mm.

2. A method for preparing a solid golf ball according to claim 1, wherein said air vent portions provided in each of said upper and lower mold halves include a first air vent portion formed around each of the poles of said upper and lower mold halves; and said first air vent portion is formed by inserting a dedicated air vent pin having a peripheral length of 5 mm or more in a first air vent pin hole with a first air vent gap having a width of 0.01 to 0.08 mm put therebetween.

3. A method for preparing a solid golf ball according to claim 1, wherein said air vent portions provided in each of said upper and lower mold halves include a plurality of second air vent portions provided around each of the poles of said upper and lower mold halves;

said second air vent portion is formed by vertically movably inserting a core-supporting/air-vent movable pin in a second air vent pin hole with an air vent gap having a width of 0.01 to 0.08 mm put therebetween; and the total peripheral length of said movable pins in each of said upper and lower mold halves is in a range of 30 mm or more.

4. A method for preparing a solid golf ball according to claim 3, wherein said second air vent portions are formed in a region within a radius of 3 to 9 mm from each of the poles of said upper and lower mold halves.

5. A method for preparing a solid golf ball according to claim 1, wherein the width of each of the gaps of said air vent portions is in a range of 0.03 to 0.07 mm.

6. A method for preparing a solid golf ball according to claim 1, wherein the total area of the gaps of said air vent portions in said upper and lower mold halves is in a range of 1.8 to 3.4 $mm^2$.

7. A method for preparing a solid golf ball according to claim 1, wherein said core has a two-layer structure having an inner layer core and an outer layer core.

8. A method for preparing a solid golf ball according to claim 1, wherein said cover is directly in contact with said core.

9. A method for preparing a solid golf ball according to claim 1, wherein the surface of said cover has marks of air vent portions.

10. A method for preparing a solid golf ball according to claim 1, wherein said air vent portions allow the cover to be evenly injected around the core.

* * * * *